US011596961B2

(12) United States Patent
Knight et al.

(10) Patent No.: US 11,596,961 B2
(45) Date of Patent: Mar. 7, 2023

(54) RECYCLABLE, PRE-COMPRESSION DISPENSER WITH TRIGGER SPRAYER

(71) Applicant: RIEKE LLC, Auburn, IN (US)

(72) Inventors: Simon Christopher Knight, Bridgend Mid Glamorgan (GB); Gaurang Mittal, Uttar Pradesh (IN); Prantik Chanda, Delhi (IN)

(73) Assignee: RIEKE LLC, Auburn, IN (US)

( * ) Notice: Subject to any disclaimer, the term of this patent is extended or adjusted under 35 U.S.C. 154(b) by 148 days.

(21) Appl. No.: 17/047,148

(22) PCT Filed: Apr. 15, 2019

(86) PCT No.: PCT/US2019/027462

§ 371 (c)(1),
(2) Date: Oct. 13, 2020

(87) PCT Pub. No.: WO2019/200380

PCT Pub. Date: Oct. 17, 2019

(65) Prior Publication Data

US 2021/0146389 A1 May 20, 2021

Related U.S. Application Data

(60) Provisional application No. 62/657,296, filed on Apr. 13, 2018.

(51) Int. Cl.
*B05B 11/00* (2006.01)

(52) U.S. Cl.
CPC ..... *B05B 11/303* (2013.01); *B05B 11/304* (2013.01)

(58) Field of Classification Search
CPC . B05B 11/303; B05B 11/304; B05B 11/0059; B05B 11/3035; B05B 11/00442; B05B 11/0029; B05B 11/3067; B65D 37/00
See application file for complete search history.

(56) References Cited

U.S. PATENT DOCUMENTS

| | | | | |
|---|---|---|---|---|
| 4,222,501 A | | 9/1980 | Hammett | |
| 4,260,079 A | * | 4/1981 | Cary | B05B 11/3035 222/214 |
| 4,310,107 A | * | 1/1982 | Wesner | B05B 11/3076 417/560 |
| 4,867,347 A | * | 9/1989 | Wass | B05B 11/3015 222/207 |
| 5,114,052 A | * | 5/1992 | Tiramani | B05B 11/3035 222/207 |
| 5,297,701 A | | 3/1994 | Steijns et al. | |

(Continued)

OTHER PUBLICATIONS

Patent Cooperation Treaty (PCT), International Search Report and Written Opinion for Application PCT/US2019/027462 filed on Apr. 15, 2019, dated Jun. 27, 2019, International Searching Authority, US.

(Continued)

*Primary Examiner* — Bob Zadeh
(74) *Attorney, Agent, or Firm* — McDonald Hopkins LLC

(57) ABSTRACT

A trigger sprayer is made from a single grade of polymer capable of being reused as post consumer resin. The design allows for upright and inverted actuation. A pre-compression diaphragm ensures that dispensing stroke delivers a complete and uniform amount of fluid.

11 Claims, 8 Drawing Sheets

(56) References Cited

U.S. PATENT DOCUMENTS

| | | | | |
|---|---|---|---|---|
| 5,341,967 | A * | 8/1994 | Silvenis | B05B 11/3011 222/402.19 |
| 5,425,482 | A | 6/1995 | Foster et al. | |
| 5,540,360 | A | 7/1996 | Foster | |
| 5,603,434 | A * | 2/1997 | von Schuckmann | B05B 11/0044 222/481.5 |
| 6,279,784 | B1 | 8/2001 | O'neill | |
| 6,527,202 | B1 * | 3/2003 | Tseng | B05B 11/3035 222/207 |
| 9,409,195 | B2 | 8/2016 | Dejong | |
| 11,014,108 | B2 | 5/2021 | Knight | |
| 2008/0230563 | A1 * | 9/2008 | Maas | B05B 11/0008 222/383.1 |
| 2012/0261438 | A1 * | 10/2012 | Dejong | B05B 11/3069 222/383.1 |
| 2013/0020355 | A1 * | 1/2013 | Alluigi | B05B 11/3067 222/383.1 |
| 2021/0146389 | A1 * | 5/2021 | Knight | B65D 37/00 |

OTHER PUBLICATIONS

Extended European Search Report dated Nov. 26, 2021; European Patent Application No. 19785194.2.

* cited by examiner

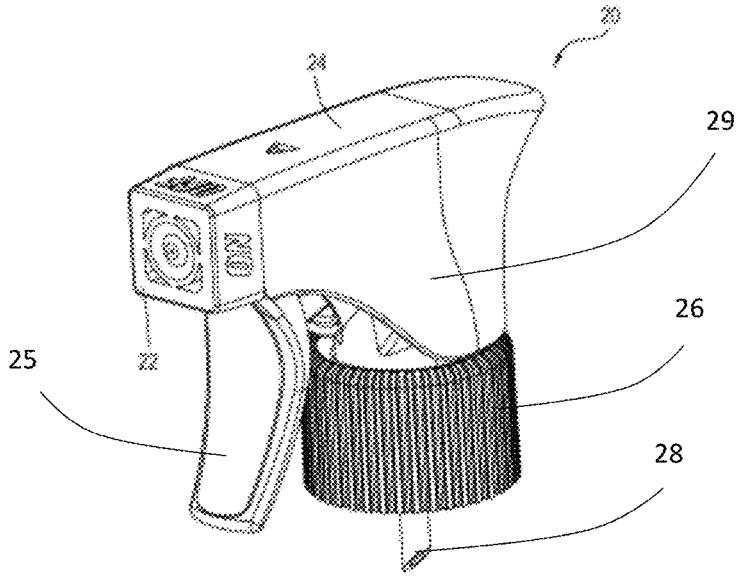
FIGURE 1A
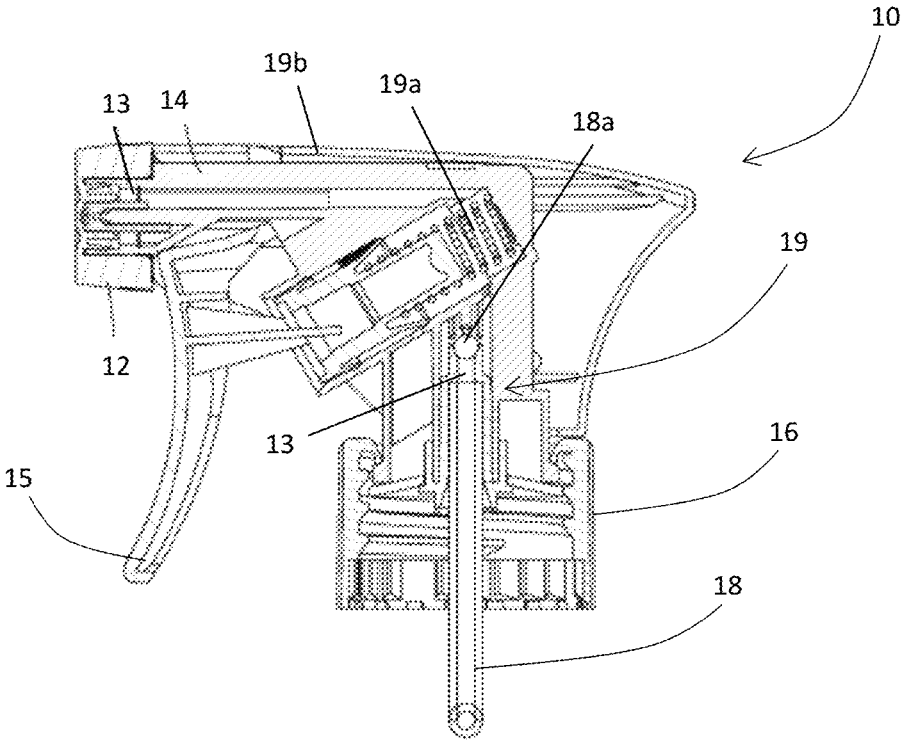
FIGURE 1B -- PRIOR ART

RECYCLABLE, PRE-COMPRESSION DISPENSER WITH TRIGGER SPRAYER

CROSS-REFERENCE TO RELATED APPLICATION

This application is a 35 U.S.C. 071 national stage application of PCT Application No. PCT/US2019/027462 filed on Apr. 15, 2019, which claims priority to U.S. Provisional Patent Application Ser. No. 62/657,296, filed on Apr. 13, 2018 each of which are incorporated by reference in its their entirety.

The present invention relates generally to a trigger sprayer and, more specifically, to a pre-compression trigger sprayer made entirely from the same grade of polymeric material, without reliance upon any metal parts.

BACKGROUND

At present, a class of pump dispensers can be made from post consumer resin (PCR) ranging from 67% to 100%, in terms of PCR recycled content. As consumers and manufacturers continue to support sustainability initiatives, the demand for these type of dispensers is expected to grow. Correspondingly, dispensers made from a single grade of polymeric material, without reliance on any metallic or glass components, are particularly desirable insofar as they themselves can be converted into PCR base material without the need for disassembly or separation of plastic from non-plastic components.

Over the years there have been many proposals for avoiding the use of metal in pumps. Deformable pump chambers, typically using a single bellows constructions and elastomer or thermoplastic elastomer materials, have been proposed and used. However these materials are expensive as well as usually non-recyclable, while bellows-form chambers are seldom effective.

U.S. Pat. No. 4,867,347 describes a pump chamber having a resiliently restorable flexible wall which could be made from standard plastics such as polypropylene. Restoring force is provided by a special form of the flexible wall, comprising at least one facet having a concave boundary and a curved surface portion interrupting the facet to induce bending thereof in the dispensing stroke, this bending producing a strong restoring force tending to restore the flexible wall to the rest condition. The curved surface portion—typically a cylindrical surface portion—is axially inclined to the facet and meets it along the concave boundary. In the preferred form the flexible wall has the shape of a polygonal pyramid with plural facets. While this structure can be molded integrally with adjacent components, the restoring force achieved was inconsistent and sometimes inadequate so that the design was never adopted in widespread commercial uses.

Trigger sprayers are class of dispensers in which a directional nozzle dispenses fluid along a known and expected flowpath. Such dispensers usually rely on atomization to evenly disperse the fluid and/or to create a mist therefrom. Consumers often prefer these type of dispensers for cleaning and personal care products precisely because of this predictable, projecting dispensing pattern. The trigger sprayer assembly itself is characterized by closure that couples to a container, with a handle or trigger-type actuator positioned beneath the barrel of a horizontal projecting outlet. The outlet may include a rotatable nozzle assembly to open, close, and/or toggle between various types of spray patterns (mist, stream, wide cone, narrow cone, etc.). One such trigger is described in international patent publication number WO 2018/049373, filed on Sep. 12, 2017.

However, in trigger dispensers, it is also desirable to employ a "pre-compression" arrangement so that fluid is forcefully and completely dispensed upon the first actuation of the trigger (after an initial priming when the dispenser is used for the very first time). In this manner, precompression reinforces and further ensures that the dispensing path will be consistent and known (i.e., without an initial stroke whereby the fluid fails to fully project and/or disperse as designed and intended).

United States Patent Publication 2008/0230563 discloses a pre-compression style trigger sprayer. A pre-compression valve is employed to create predetermined pressure prior to actuation. The valve itself is an elastic diaphragm, while flexion springs are used to urge the actuator and piston into position.

Thus, a trigger sprayer dispenser made from a single grade of polymeric material is needed. Further, such a sprayer having pre-compression functionality would be even more desirable. Finally, a design that could be used in a standard, vertical orientation, as well as continue to dispense when inverted, would be welcome.

For the sake of clarity and to further highlight and contrast with certain aspects of the invention disclosed herein, all of the aforementioned disclosures are incorporated by reference into this Background section.

SUMMARY OF INVENTION

Specific reference is made to the appended claims, drawings, and description, all of which disclose elements of the invention. While specific embodiments are identified, it will be understood that elements from one described aspect may be combined with those from a separately identified aspect. In the same manner, a person of ordinary skill will have the requisite understanding of common processes, components, and methods, and this description is intended to encompass and disclose such common aspects even if they are not expressly identified herein.

A trigger sprayer design avoid the use of metal parts, elastomers, or other disparate materials. A pre-compression diaphragm is included to ensure uniform and consistent dispensing of fluid, while an inverted flow bypass ensures the sprayer operates in both upright and inverted positions.

In one aspect, the trigger sprayer may include any combination of the following features:

- a pump body coupled to a resilient bellows and a pre-compression diaphragm, said pump body also having an outlet nozzle and a ball valve sealing an inlet of the pump body;
- a trigger actuator attached to the pump body so as to allow for pivotal engagement of the trigger actuator in a manner that compresses the resilient bellows;
- a closure coupled to the pump body proximate the inlet;
- wherein the resilient bellows and the pump body define a dispensing chamber having a volume that varies in response to the pivotal engagement of the trigger actuator and the resilient bellows;
- wherein the pre-compression diaphragm and the pump body define a pre-compression chamber with the pre-compression diaphragm being displaced to open a flow path from the dispensing chamber to the outlet when sufficient fluid pressure is created within the pre-compression chamber by fluid provided from the pivotal engagement of the trigger actuator and the resilient bellows;

an inverted flow path sealed by a valve and including an inverted flow chamber, said inverted flow path providing a bypass of the inlet and ball valve;

wherein the pre-compression diaphragm includes a side wall with a stepped engagement portion and a flexible central panel which moves in response to a pre-determined fluid pressure;

wherein the diaphragm includes a thickened base portion;

wherein the resilient bellows include a plurality of panel facings oriented around a thickened central engagement panel, said central engagement panel being contacted by the trigger actuator and wherein the resilient bellows has a frusto-conical shape;

wherein each panel facing includes an upturned curve so as to attached to the central panel at an angle sufficient to create biasing force urging the resilient bellows into the frusto-conical shape;

wherein the trigger actuator includes a stopping member which abuts the pump body so as to limit pivotal engagement of the trigger actuator;

wherein the nozzle outlet is rotatable around a dispensing axis so as to open or close the nozzle outlet;

wherein the pump body, the trigger actuator, and the closure are made from the same grade of polymeric material; and wherein the polymeric material consists of polypropylene.

DESCRIPTION OF THE DRAWINGS

Operation of the invention may be better understood by reference to the detailed description taken in connection with the following illustrations. These appended drawings form part of this specification, and any information on/in the drawings is both literally encompassed (i.e., the actual stated values) and relatively encompassed (e.g., ratios for respective dimensions of parts). In the same manner, the relative positioning and relationship of the components as shown in these drawings, as well as their function, shape, dimensions, and appearance, may all further inform certain aspects of the invention as if fully rewritten herein. Unless otherwise stated, all dimensions in the drawings are with reference to inches, and any printed information on/in the drawings form part of this written disclosure.

In the drawings and attachments, all of which are incorporated as part of this disclosure:

FIG. 1A is a perspective view of an exemplary trigger sprayer head.

FIG. 1B is a cross sectional side view of trigger sprayer according to the prior art.

FIG. 2A is a side plan view of one embodiment of the trigger sprayer disclosed herein, while

FIG. 4A is a cross sectional side view of FIG. 2A, while

DETAILED DESCRIPTION OF EMBODIMENTS

Figure 2A:
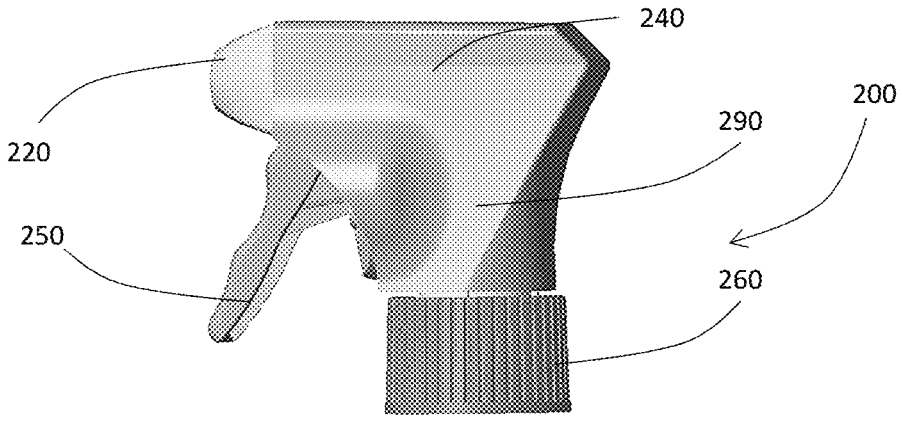

As used herein, the words "example" and "exemplary" mean an instance, or illustration. The words "example" or "exemplary" do not indicate a key or preferred aspect or embodiment. The word "or" is intended to be inclusive rather an exclusive, unless context suggests otherwise. As an example, the phrase "A employs B or C," includes any inclusive permutation (e.g., A employs B; A employs C; or A employs both B and C). As another matter, the articles "a" and "an" are generally intended to mean "one or more" unless context suggest otherwise.

United States' patent publication number 2018/0318861, filed on Apr. 25, 2018 discloses dispensers made from a single polymeric material and a trigger sprayer, respectively speaking. Its drawings, background, and description are incorporated by reference herein, along with any earlier or later filed application within the priority claims of this publication.

FIG. 1A illustrates an exemplary trigger sprayer design. Spray head 20 includes a horizontally oriented barrel or channel 24 having a nozzle outlet 22 at its distal end. A trigger actuator 25 is positioned proximate to and beneath barrel 24. The trigger 25 is generally orthogonal to the orientation of the barrel 24 and its actuation is in a substantially horizontal direction (when the container is upright). A closure skirt 26 couples to the opening in a container (not shown), while the dip tube 28 extends into the container and draws fluid up into the body 29 and out the dispenser nozzle 22 by way of a pump mechanism (not shown). Notably a plastic shroud may encase the body 29 to create a more streamlined aesthetic. In total, this arrangement ensures that, when used, the fluid is dispensed in a known and predictable path.

As used herein, trigger sprayers must be distinguished from dispensing pumps, where the fluid flows directly downward owing to the force of gravity. Most dispenser pumps rely on a reciprocating actuator head that is pushed downward (i.e., vertically). This arrangement does not include a trigger and, instead, usually requires the actuator to have a flattened head.

FIG. 1B illustrates a prior art trigger sprayer which will help to highlight still other distinguishing features of certain aspects of the invention below. Here, prior art trigger sprayer 10 includes a nozzle 12 and barrel 14. Internal flow channel 13 fluidically connects dip tube 18 (which extends into and draws fluid from the container) and the outlet formed in nozzle 12. Therebetween, pump body 19 is actuated by trigger 15. The pump 19 includes a metallic spring 19*a* which creates suction within the channel 13 when the trigger 15 is depressed and released. Glass or metal ball valve 18*a* temporarily seals channel 13 to facilitate dispensing and to avoid unwanted contamination or leakage of fluid from the container. Skirt 16 includes internally facing screw threads that couple to the container neck.

Figure 2B:
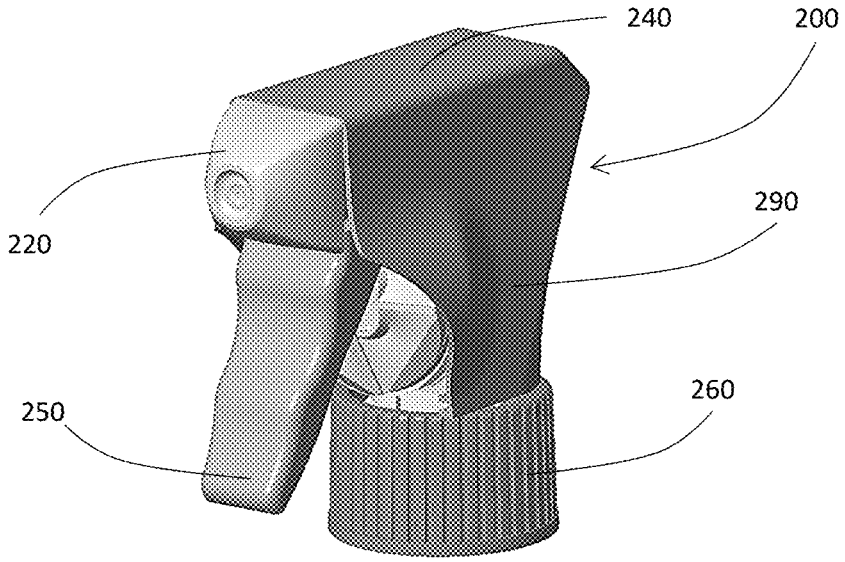
FIG. 2B is a perspective view of FIG. 2A.
Figure 3:
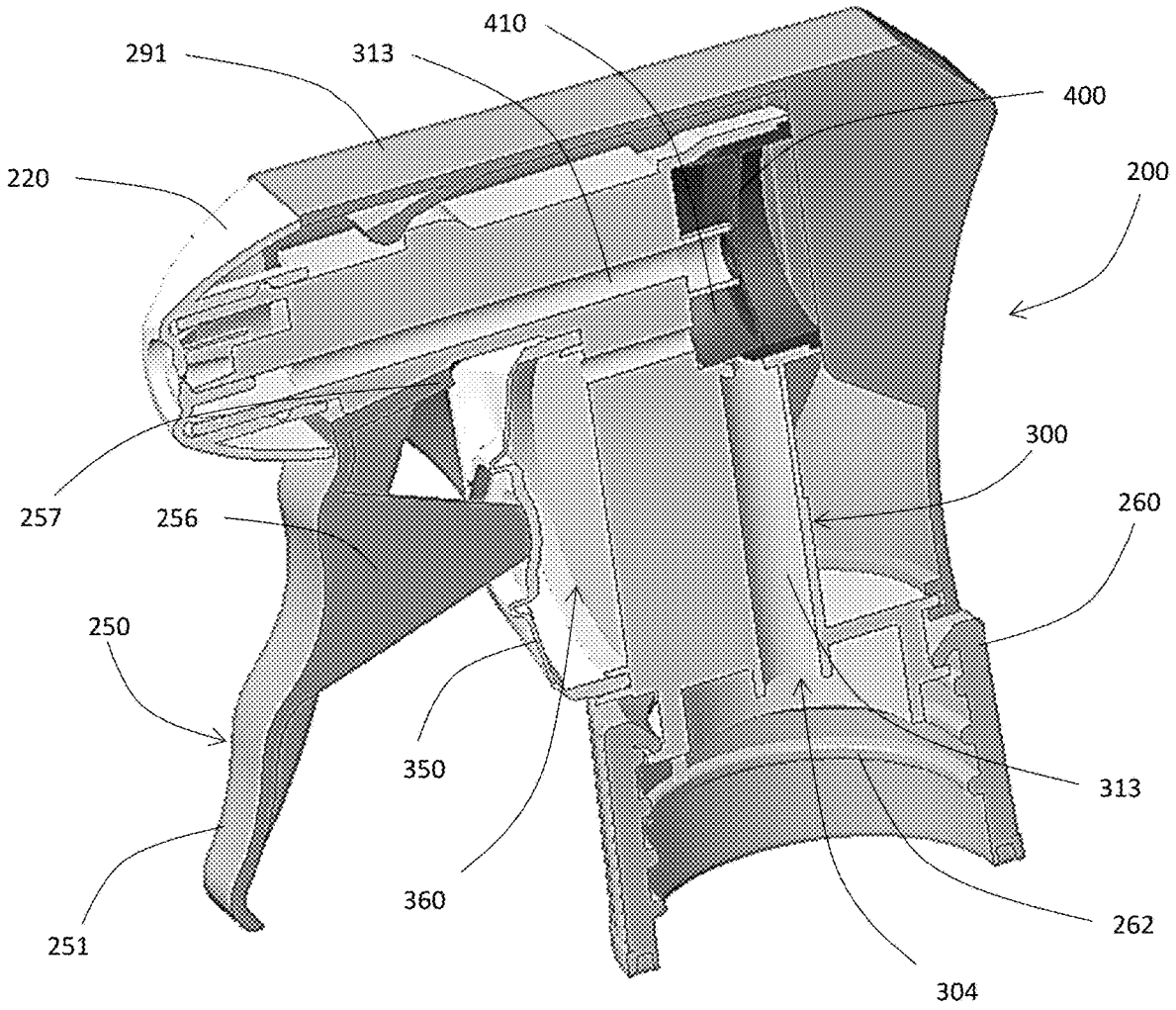
FIG. 3 is a cross sectional perspective view of FIG. 2A, but with the structure for the ball valve and dip tube omitted to better illustrate certain aspects of the closure.
Figure 4A:
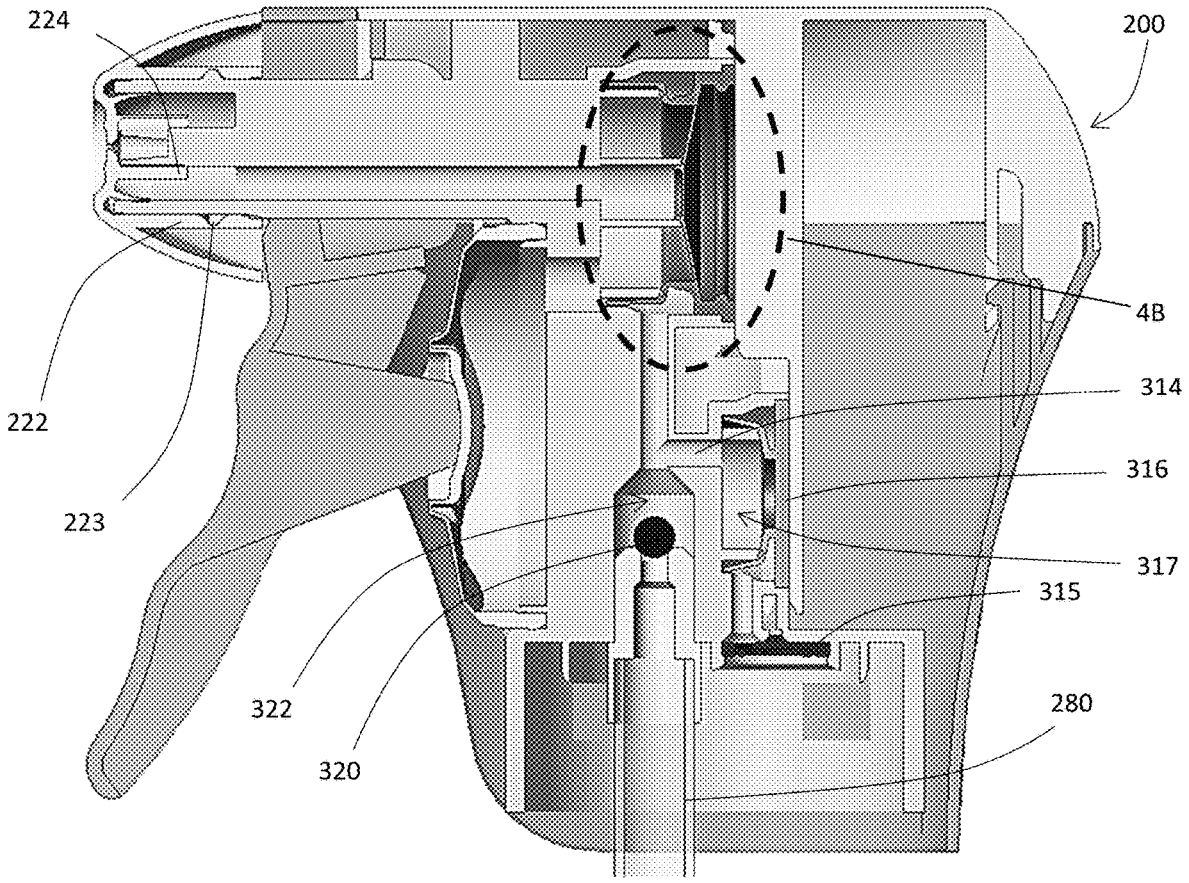
Figure 4B:
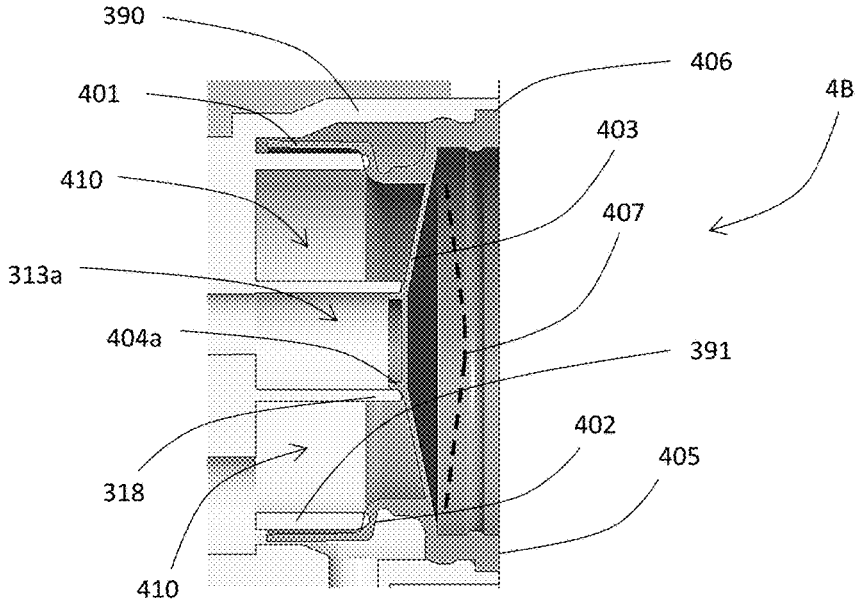
FIG. 4B is an enlarged view of callout 4B in FIG. 4A.
Figure 5:
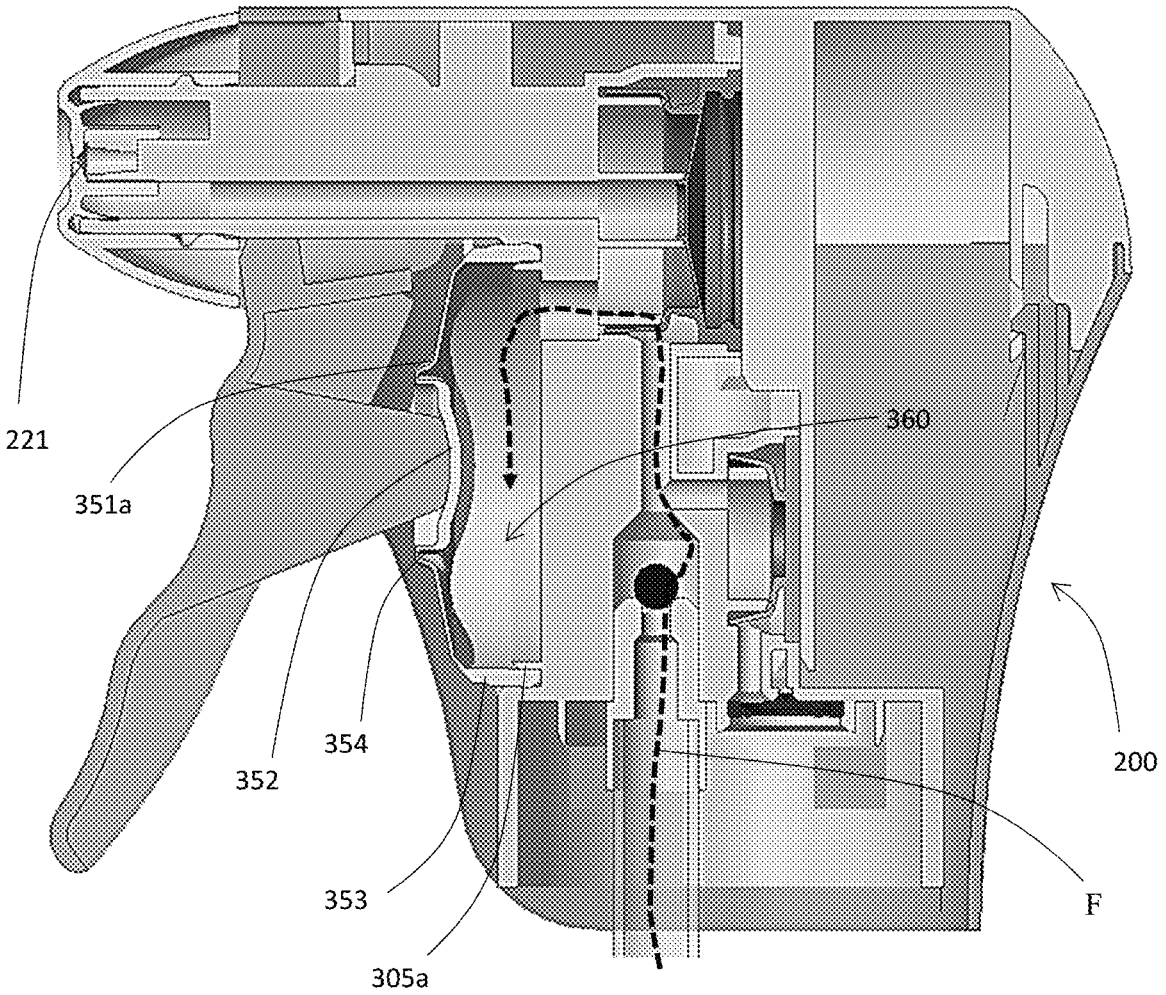
FIG. 5 is a cross section side view of the trigger sprayer disclosed herein operating in its vertical or upright position, while illustrating the flow path of fluid drawn from the container into the bellows.
Figure 6:
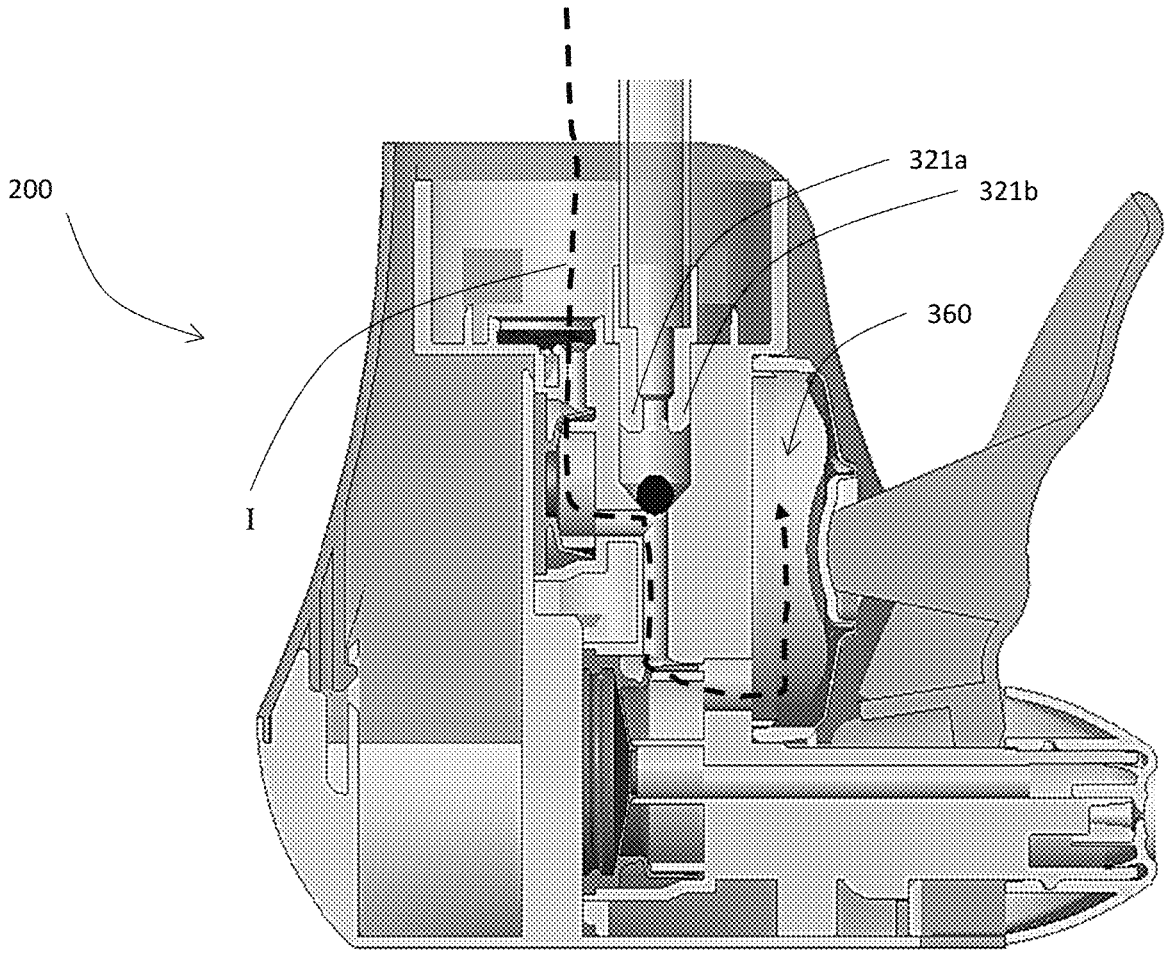
FIG. 6 is a cross section side view of the trigger sprayer disclosed herein operating in its inverted or upside down position, while illustrating the flow path of fluid drawn from the container into the bellows.
Figure 7:
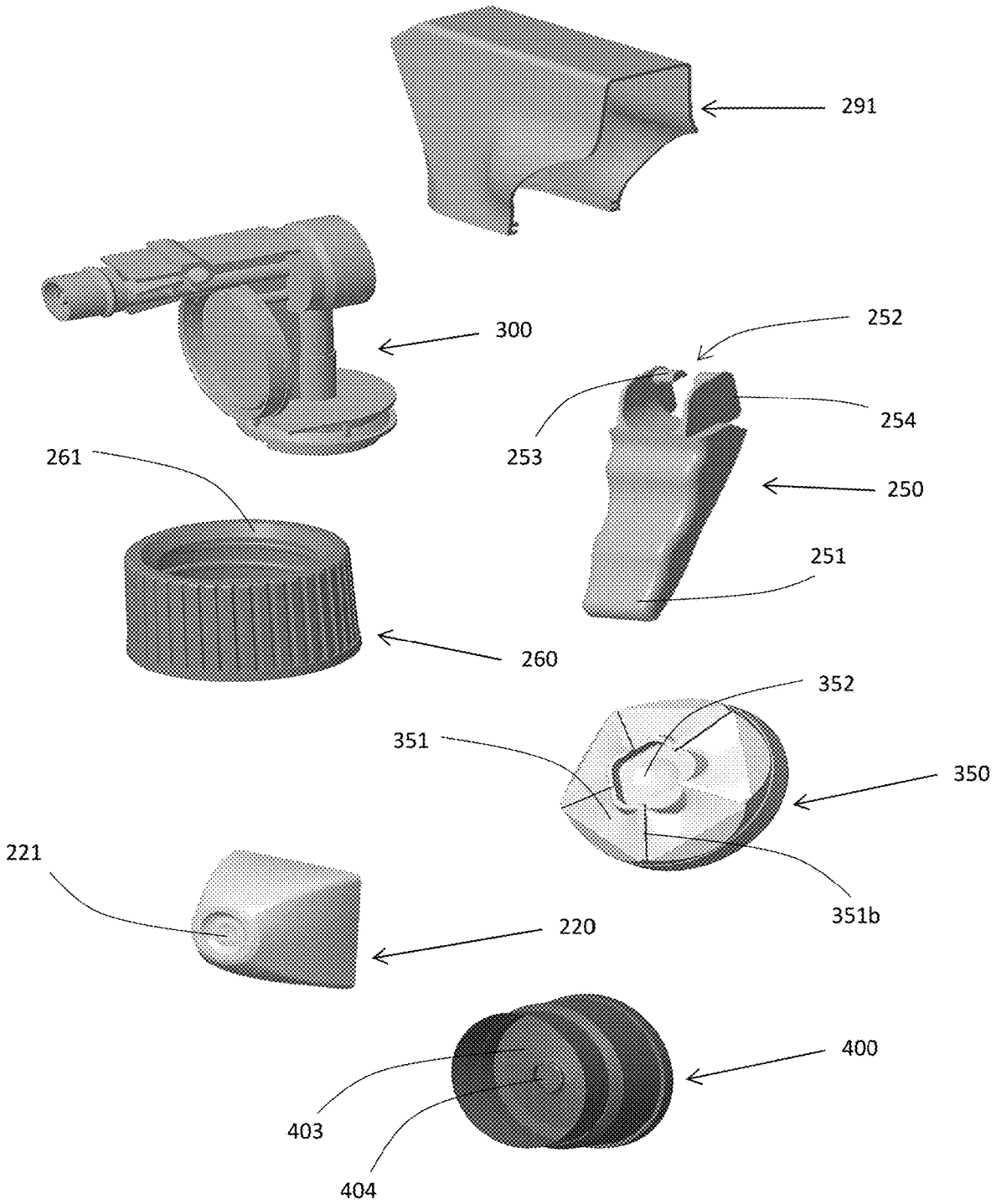
FIG. 7 is a series of isolated perspective views of the individual components of the trigger sprayer disclosed herein.
Figure 7A:
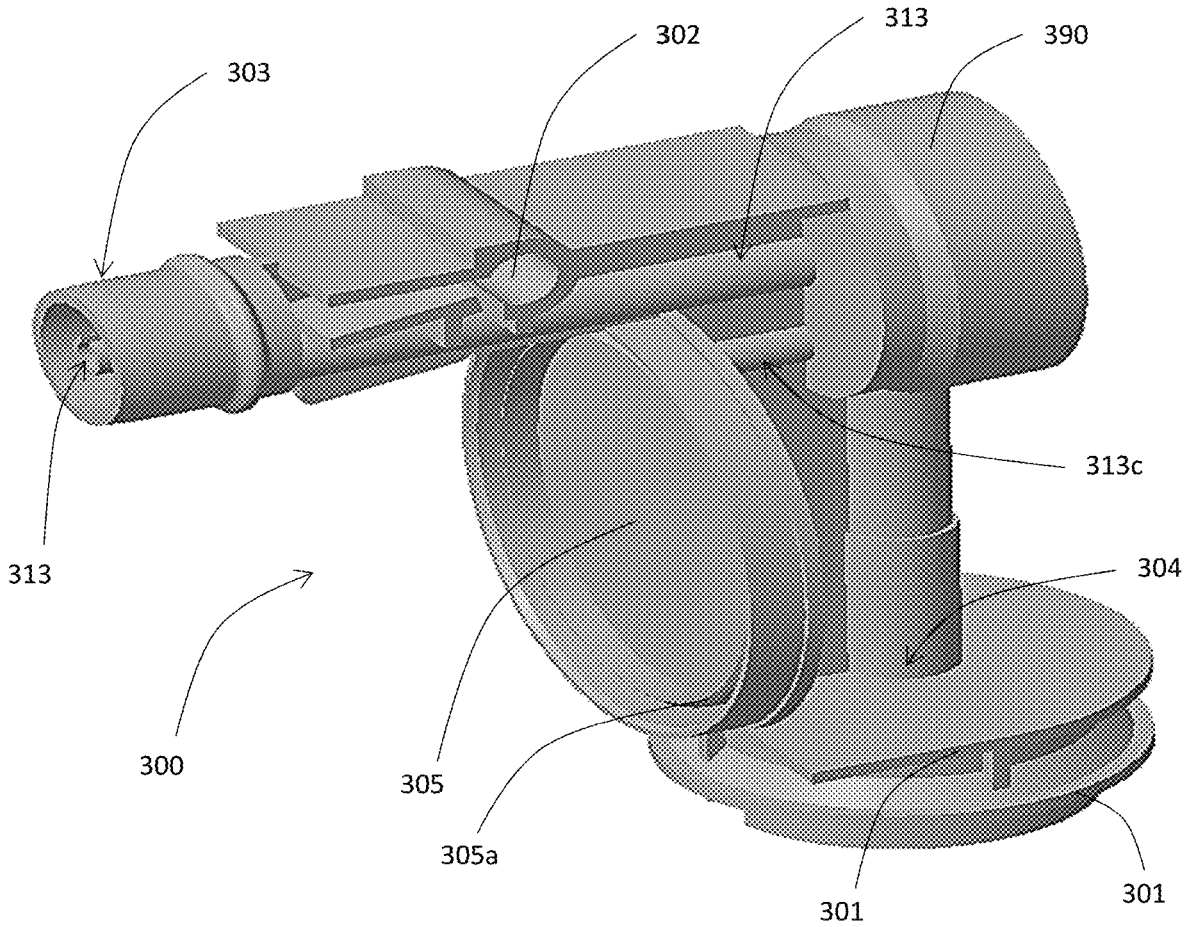
FIG. 7A is an enlarged perspective view of the isolated pump element 300 shown in FIG. 7.

In contrast, FIGS. 2A-7 illustrate various aspects of the inventive trigger sprayer 200. Sprayer 200 includes trigger actuator 250, nozzle outlet 220, dispenser barrel head 240, dispenser body 290, and closure skirt 260. Generally speaking, these components are all visible on the exterior and serve many of the same functions and purposes as described above. Most significantly, given its trigger actuation, sprayer 200 is separate and distinct from reciprocating pumps and other dispensers because sprayer 200 dispenses fluid along a specific, directed path and, preferably, in one or more specific, intended configurations (fine mist, liquid stream, etc.).

Body 290 is defined along its exterior by shell or shroud 291. Shroud 291 encases and protects the internal components of the body 290 described below. As such, shroud 291 couples to pump 300 by attachment means, such as snap fitting, interference fitting, fasteners, or adhesive, along one or more circumferential flanges 301 proximate to the pump base 310. In the same manner, nozzle piece 220 relies upon the same types of attachment means, while the attachment of trigger 250 may be to pump 300 and/or shroud 291, so long as trigger 250 is permitted to pivot or flex so as to engage bellows 350, as described below.

Shroud 291 defines a hollow interior cavity into which the sprayer 200, excepting trigger actuator 250, are partially or completely received. As such, shroud 291 may be provided with various aesthetic features and shapes without departing from one of the aspects of the invention, so long as the shroud 291 is made from the same material as the remaining components of sprayer 200. Shroud 291 may also be provided with interior-facing webbing or reinforcement ribs to provide additional strength and resistance to impact for the entirety of sprayer 200.

In a similar manner to shroud 291, closure 260 attaches to flanges 301 or other structure at the base of pump 300. Closure 260 itself is formed as a hollow cylindrical tube 261 which forms a skirt when couples to the sprayer 200 (usually by way of pump 300, as noted above). Threads or other engagement features 262 are formed on an inner facing of tube 261 so as to allow for selective attachment to corresponding features formed on the container neck. Knurls, ribbing, or other grip-promoting surfaces (and/or aesthetic features) are formed on the exterior surface of tube 261.

Trigger actuator 250 includes an elongated handle portion 251 at one end and pivotal attachment formations 252 at the opposing end. In one embodiment, the pivotal attachment 252 takes the form or one or two posts 253 formed on opposing flanges 254. The flanges 254 may provide inward biasing force so that the posts can be snap-fitted and held in place on a corresponding through hole or nesting nub(s) 302 on pump mechanism 300.

A flattened extension 256 is formed on the underside of handle portion 251. Extension 256 engages resilient bellows 350 so as to deform and depress the bellows 350 when trigger 250 is actuated and pivots inwardly toward bellows 350. In turn, the shape of bellows 350 (described below) provides biasing force to return trigger 250 to its original position when actuation/pivoting is complete. Stopper extension 257 may be formed on the pivoting end of trigger 250 so as to engage the pump 300 (or other structure on the shroud 291), thereby preventing the trigger 250 from pivoting and depressing the bellows beyond a predetermined point. Thus, stopper 257 ensures the bellows 350 cannot be damaged or compressed to the point where it is unable to spring back to its desired position. In one embodiment, stopper 257 is formed integrally on the flanges 254 and/or proximate to the posts 253.

Nozzle 220 is a cup shaped member with a central outlet aperture 221. A first coaxial cylinder 222 is provided inside of the cup shape to attach to the pump 300 at pump outlet end 303. Cylinder 222 includes a groove 223 which receives a corresponding protrusion formed on end 303. The groove 223 may define a space that allows for rotation of the nozzle 220 relative to the dispensing axis formed by channel outlet 221.

A second coaxial cylinder 224 extends into the cupped interior of nozzle 220. Cylinder 224 is formed and, in combination with end 303, defines a flowpath for fluid to pass through nozzle 220 and through outlet 221. An aperture or variation in the wall of cylinder 224 can allow for nozzle 220 to be rotated between open and closed positions. Further, outlet 221 may be shaped to create a desired dispensing pattern or series of patterns as nozzle is rotated to various positions.

Dip tube 280 attaches to the inlet end 304 of pump 300. Dip tube 280 is a hollow cylinder that ensures fluid can be drawn from the bottom reaches of the container when the container/sprayer is in its upright position. While a simple interference fit between tube 280 and inlet 304 is contemplated, attachment means similar to those described above could be employed.

Resilient bellows 350 attach to a corresponding pump disk 305 formed on the pump 300 proximate to/facing the trigger 250. The bellows 350 include a plurality of panels 351 attached to a central panel 352 with a cylindrical side wall 353 engaging cooperating formations 305*a* on the periphery of disk 305. Central panel 352 may be slightly recessed, relative to its connection point with the peripheral edges of panels 351. In fact, a slight upturn or curve 351*a* creates an acute angle 354 at the junction between panels 351 and 352. In this manner, panel 352 engages extension member 256 with resiliency/biasing force that returns trigger 250 its outer, extended position once actuating force is released.

The arrangement of panel 351, 352 and side wall 353 impart a generally frusto-conical shape to bellows 350. Further, insofar as side wall 353 seals to disk 305, a reservoir or pumping chamber 360 is formed therebetween.

In some embodiments, central panel 352 and/or side wall 353 have a greater thickness than panels 351. This arrangement ensures that the panels 351 will deform and move into the pump chamber 360 when the trigger 250 is actuated. As the trigger 250 is released and the panels 351 return to their original shape, chamber 360 expands and returns to its original shape so as to create suction into chamber 360.

As shown, panels 351 present a substantially pentagonal facing bounded by the periphery of side wall 352 at one edge and the periphery of panel 352 (including upturn 351*a*) at the opposing edge. The remaining sides of each panel 351 are connected together by five equally spaced spines 351*b*. The spines 351*b* can be imparted with a greater thickness to further facilitate the biasing action imparted by bellows 350.

While five panels 351 are illustrated, it may be possible to employ a different number. For example, three, four, six, seven, or eight panels can be used.

Detented arc or scooped section 351*c* may be included as part of each panel 351. Arc 351*c* is interposed between the panel facing and the side wall 352, so as to facilitate the biasing action of the bellows 350.

Pump member 300 itself forms an integral aspect of the invention. Generally speaking, pump 300 encloses a flow path 313. Flow path 313 begins at inlet end 304, which is positioned proximate to the container and closure 260 at the base end. Flow path 313 then terminates at the outlet end 303 where the nozzle 220 snap fits to the body.

Ball valve 320 is positioned within flow path 313 immediately adjacent to and downstream from an inlet 304. Formations 321*a*, 321*b* ensure that ball 320 is retained within a chamber 322 but sufficient range of motion to permit fluid flow depending upon the positioning of ball 320 (either due to suction force within the path 313 or to the inversion of sprayer 200). Notably, as used herein, the flowpath begins in the container and ends as the fluid is dispensed out of nozzle outlet 221, so that ball valve 320 is downstream from the inlet 304 but upstream from outlet 221 (and so on).

Pre-compression diaphragm 400 moves laterally through a portion of pre-compression chamber 410. Notably, an annular reservoir 410 allows fluid provided from chamber 360 to build up and become pressurized while the diaphragm is in its natural, sealed arranged against barrel flow channel 313*a*. When sufficient pressure is realized, fluid pushes diaphragm 400 away from its sealing face with channel 313*a* and toward boundary 411. In this manner, fluid is reliably dispensed at full volume and force through the nozzle 220, without the user experiencing an initial, weakened dispensing action.

Diaphragm 400 is cup shaped, with barrel-engaging side walls 401 sealingly engages a cylindrical member 390 formed within flow path 313. Member 390 retains side walls 401, while a step section 402 in the diaphragm 400 ensures that fluid stays within the chamber 410. Chamber 410 is, itself, defined by member 390 and the circular panel 403 of the diaphragm.

Insofar as step section 402 is provided along a complete circumference of the side wall 401, it effectively creates a circumferential groove separating the base 405 from the top side walls 401 which seal to the body 300. Further, along the upstream portion of side wall 401 (i.e., the bottom edge closest to inlet 304 in the upright position), it may serve as a flap valve to control liquid and/or air flow through path 313 and into chamber 360, while simultaneously separating and defining annular chamber.

Panel 403 includes a central sealing face 404 to block channel 313*a*. When sufficient fluid pressure is exerted by actuation, panel 403 flexes backward to its open or discharge position (as indicated by dotted line 407) to enlarge chamber 410 and allow fluid to pass through channel 313*a* and nozzle 220. Sealing face 404 may include a circular ridge 404*a* to engage and seal a cylindrical extension 318 of the pump 300 at channel 313*a*.

The thickened base section 405 of diaphragm 400 exerts sufficient biasing force to return panel 403 to its original position. In order to ensure diaphragm 400 remains attached to pump 300, a circumferential flange 406 is provided at the base end 405, with flange 406 coupling to a corresponding groove formed in the pump 300.

In upright operation, actuation and release of trigger 250 creates suction by the resilient action of bellows 350. This draws ball valve 320 off its sealing seat at the bottom of chamber 322 and allows fluid from the container to flow (via dip tube 280) into chamber 360. After the pump 300 is initially primed, the volume of chamber 360 is sufficiently large enough, relative to chamber 410 to ensure the next actuation creates sufficient pressure to displace pre-compression diaphragm 400 and create a complete dispensing action. Dotted line F indicates how liquid is drawn from the container, via the dip tube 280, and into chamber 360.

Make up air can flow back into chamber 360 via the nozzle 220, which does not require a separate ball valve. Make up air is also provided to the container via valve 315, which communicates with the ambient environment through a gap between the pump 300 and the shroud 291.

An alternative, inverted flow channel 314 is provided, with dotted line I indicating how liquid is drawn from the container into the chamber 360. Here, the channel 314 is normal sealed from the container by resilient flap valve 315. Valve 316 is positioned proximate to an inverted flow chamber 317. When the sprayer 200 is inverted and actuated, fluid is drawn through valve 315, into chamber 317, and introduced back into the normal flow path 313 downstream from the ball chamber 322. Notably, the force of gravity ensures that ball 320 nests within a cone shaped funnel in chamber 322 so as to seal and prevent air or fluid from being drawn through the dip tube 280 during inverted actuation.

In this manner, chamber 317 fills first, with continued actuation drawing fluid into chamber 360. The fluid is then dispensed via the pre-compression mechanism and out the nozzle outlet 221 as noted above. During inverted actuation, make-up air is drawn through valve 315, while the biasing force of the bellows 350 will fill chamber 360 with fluid as trigger 350 is released. As above, pre-compression diaphragm 400 will be displaced upon sufficient pressurization as part of the actuation sequence.

Whether inverted or upright, once liquid fills the chamber 360, further actuation urges the liquid into annular chamber 410. As noted above, once sufficient pre-compression pressure is sustained in chamber 410, the panel 403 flexes backward to open channel 313*a* (which is, itself, defined by a cylindrical protrusion 318 which defines part of chamber 410 along its exterior, and flow path 313 along its interior). Fluid is delivered to and from chamber 360 via side channel 313*c*. Notably, side channel 313*c* is effectively divided any annular body extension 391, with one portion directed into annular chamber 410 and the other leading back downstream toward ball valve 320 (this portion is also selectively sealed by side wall 401).

All components should be made of materials having sufficient flexibility and structural integrity, as well as a chemically inert nature. The materials should also be selected for workability, cost, and weight. Common polymers amenable to injection molding, extrusion, or other common forming processes are useful, although a single grade is preferred. As such, polypropylene is expected to have particular utility for every component described in FIGS. 2A through 7. In fact, a key reason consumers, manufacturers, and others will find utility in these designs/components is precisely because of the use of only a single grade of polymer (e.g., polypropylene) that should greatly simplify recycling of the inventive trigger sprayer.

Although the present embodiments have been illustrated in the accompanying drawings and described in the foregoing detailed description, it is to be understood that the invention is not to be limited to just the embodiments disclosed, and numerous rearrangements, modifications and substitutions are also contemplated. The exemplary embodiment has been described with reference to the preferred embodiments, but further modifications and alterations encompass the preceding detailed description. These modifications and alterations also fall within the scope of the appended claims or the equivalents thereof

What is claimed is:

1. A trigger sprayer having no metallic components, the trigger sprayer comprising:

a pump body defining a flow path between an inlet and an outlet nozzle connecting to a cylindrical extension disposed between the inlet and the outlet and a ball valve retained in the pump body to seal the inlet;

a resilient bellows sealed to the pump body;

a trigger actuator attached to the pump body so as to allow for pivotal engagement of the trigger actuator in a manner that compresses the resilient bellows and returns to an initial position in response to spring force created by the resilient bellows;

a cup-shaped pre-compression diaphragm having a flexible panel and a cylindrical wall extending away from a periphery of the panel, with an edge portion of the cylindrical wall sealingly coupled to a portion of the pump body and coaxially surrounding the cylindrical extension, so that an annular pre-compression chamber is defined by an inner surface of the cylindrical wall, the flexible panel and the cylindrical extension, wherein a central section of the flexible panel is positioned to seal the cylindrical extension and, when a pre-determined fluid pressure builds in the pre-compression chamber in response to actuation of the trigger, temporarily open in response to the pre-determined fluid pressure and dispenses pressurized fluid through the outlet nozzle; and a closure coupled to the pump body proximate the inlet.

2. The trigger sprayer of claim 1, wherein the resilient bellows is seated on a disk shaped section of the pump body to define a dispensing chamber that is: i) fluidically connected to the flow path between the inlet and the pre-compression diaphragm and ii) has a volume that varies in response to the pivotal engagement of the trigger actuator and the resilient bellows.

3. The trigger sprayer of claim 1 further comprising an inverted flow path sealed by a valve and including an inverted flow chamber, said inverted flow path providing a bypass of the inlet and ball valve.

4. The trigger sprayer of claim 1 wherein the edge portion of the pre-compression diaphragm includes a side wall with a stepped engagement portion.

5. The trigger sprayer of claim 4 wherein the diaphragm includes a thickened base portion extending away from the flexible panel in an opposing direction from the cylindrical wall.

6. The trigger sprayer of claim 1 wherein the resilient bellows include a plurality of panel facings oriented around a thickened central engagement panel, said central engagement panel being contacted by the trigger actuator and wherein the resilient bellows has a frusto-conical shape.

7. The trigger sprayer of claim 6 wherein each panel facing includes an upturned curve so as to attached to the central panel at an angle sufficient to create biasing force urging the resilient bellows into the frusto-conical shape.

8. The trigger sprayer of claim 1 wherein the trigger actuator includes a stopping member which abuts the pump body so as to limit pivotal engagement of the trigger actuator.

9. The trigger sprayer of claim 1 wherein the nozzle outlet is rotatable around a dispensing axis so as to open or close the nozzle outlet.

10. The trigger sprayer of claim 1 wherein the pump body, the trigger actuator, and the closure are made from the same grade of polymeric material.

11. The trigger sprayer of claim 10 wherein the polymeric material consists of polypropylene.

* * * * *